United States Patent [19]

Perreault et al.

[11] 4,268,217

[45] May 19, 1981

[54] LOAD CARRYING APPARATUS

[76] Inventors: Arthur W. Perreault, 1125 Thomas Ave., Coquitlam, British Columbia, Canada, V3K 2L1; Leo H. Dupre, 305 Cutler, Coquitlam, British Columbia, Canada, V3K 5C1

[21] Appl. No.: 14,504

[22] Filed: Feb. 23, 1979

[51] Int. Cl.[3] ..... B66C 1/22

[52] U.S. Cl. ..... 414/740; 294/DIG. 2; 294/88; 294/104; 414/912

[58] Field of Search ..... 414/694, 740, 912, 729; 294/104, DIG. 2, 88

[56] References Cited

U.S. PATENT DOCUMENTS

| | | | |
|---|---|---|---|
| 2,526,085 | 10/1950 | Rotollo | 294/DIG. 2 |
| 3,071,265 | 1/1963 | Andre et al. | 414/694 |
| 3,263,838 | 8/1966 | Herolf | 414/740 |
| 3,441,155 | 4/1969 | Norton | 414/694 |
| 3,560,040 | 2/1971 | Funk | 294/97 |
| 3,905,498 | 9/1975 | Lely | 414/912 X |
| 4,077,529 | 3/1978 | Leyrat et al. | 414/722 |
| 4,131,210 | 12/1978 | Everson | 414/740 |

*Primary Examiner*—Stephen G. Kunin
*Assistant Examiner*—Terrance L. Siemens
*Attorney, Agent, or Firm*—Townsend and Townsend

[57] ABSTRACT

An apparatus for picking up, carrying and depositing loads is made as an attachment for a machine such as a backhoe having an articulated boom provided with a hydraulic ram normally used to operate a digging bucket. The attachment includes co-operating frames pivotally connected together as a grapple assembly readily mountable on an outer end of the articulated boom. One frame is supported to swing about a transverse axis normal to the longitudinal axis of the boom. The other frame has an end releasably secured to the boom. The swingable frame is pivotally connected to the ram through linkage originally intended to operate the bucket and the grapple assembly is then operable by the same hydraulic controls and power units of the backhoe.

3 Claims, 5 Drawing Figures

71
70
18

14
73
74
83
80
3
20
10
81
48
51
54
31
47
15
42
94
34
60
90
12
54
30
25
32
54
27
31
31
26
38
37
116
116
111
111
40
3

84
73
14
86
83
85
74
85
80
80
81
47
81
47
51
42
42
50
60
96
97
94
54
54
91
26
26
27
32
31
31
116
116
116
116
111
111
111
111

14
80
80
47
47
51
50
42
42
45
65
61
66
67
63
64
60
68
26
26
32
31
31
116
116
111
111

31
112
114
31
116
115
114
112
111
113
100
98

26
128
126
129
122
26
128
125
121
126
116
123
120
122
127
111

LOAD CARRYING APPARATUS

BACKGROUND OF THE INVENTION

This invention relates to a grapple assembly attachable to a machine as a replacement for a normally-carried implement.

An earth moving machine in widespread use today for digging trenchs and the like is commonly referred to as a "backhoe". Such a machine comprises a power-driven vehicle on which an articulated boom is mounted ot carry a digging bucket. The hydraulically operated bucket usually is mounted to dig towards the vehicle and the arrangement is a particularly effective one since the parts which support and operate the digging and scraping implement are relatively simply constructed and easily operated. A backhoe is also capable of lifting certain types of loads but an object such as a fallen tree, a stump, a rock, a length of pipe, or a bundle of loose boards cannot readily be handled by a piece of equipment of this type.

SUMMARY OF THE INVENTION

An object of the present invention is to make related equipment but particularly a backhoe more versatile by providing a tong-like grasping mechanism generally called a grapple assembly which can readily be attached to the machine as a replacement for another implement. The grapple assembly is simple and sturdily constructed and has adjustments which allow some variation in the load-moving or load-gripping action.

According to the invention, a grapple assembly of the kind referred to is characterized by the use of fixed and swingable frames which operate somewhat like a pair of tongs. The assembly is attachable to the outer end of a conventional articulated boom carrying a hydraulic ram. Mounting means secure the grapple assembly to the outer end of the boom and permit the swingable frame to swing about a transverse axis normal to the longitudinal axis of the boom. Both the fixed and swingable frames have crank portions and opposed load-gripping portions separated by the pivotal connection for the frames. The fixed frame is adjustably secured to the boom with the load-gripping portion of that frame projecting beyond the end of the boom to oppose the corresponding portion of the swingable frame. The crank portions of the swingable frame are connected by linkage to the hydraulic ram so that operation of the ram will move the grapple assembly between open and closed positions.

DESCRIPTION OF THE PREFERRED EMBODIMENTS

Figure 1:
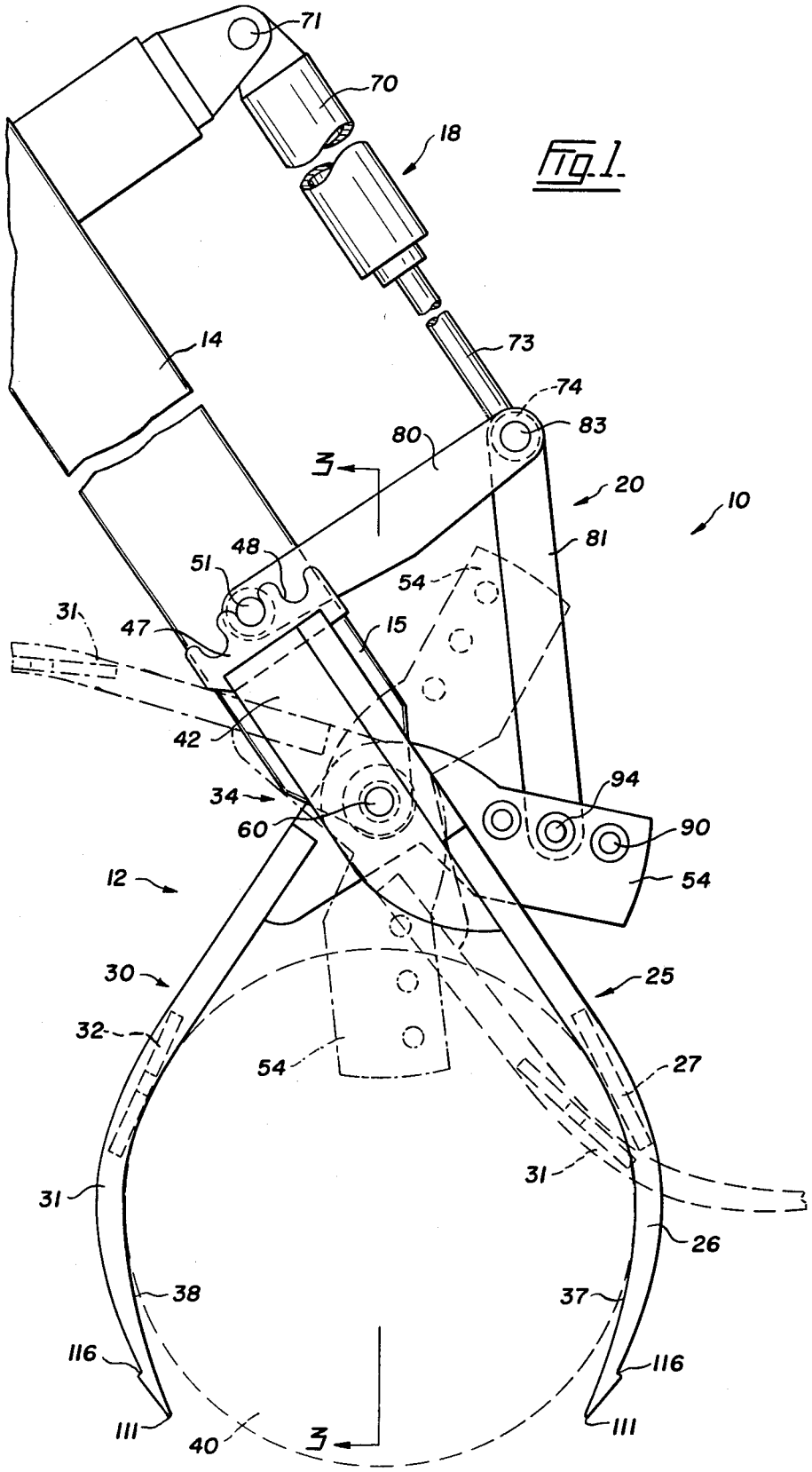
FIG. 1 is a side elevation of the present load-carrying apparatus.

The numeral 10 indicates generally a load carrying apparatus constructed in accordance with the present invention. This apparatus comprises a grapple assembly 12 which is designed as an attachment for a conventional earth-moving machine (not shown) having an articulated boom 14 which normally carries a bucket. Only the boom 14 is shown in FIG. 1 but it will be appreciated the boom is operated by conventional hydraulic means carried by the machine so that an outer end 15 of the boom can be raised and lowered as well as moved back and forth as required to manipulate a backhoe-type bucket when digging a trench or otherwise moving earth or other material. The bucket is swung about a horizontal axis extending transversely of the end of the boom by means of a hydraulic ram 18. This ram is operatively connected to the bucket by linkage means 20. The boom, ram and linkdage arrangements are utilized to operate the present grapple assembly.

Figure 3:
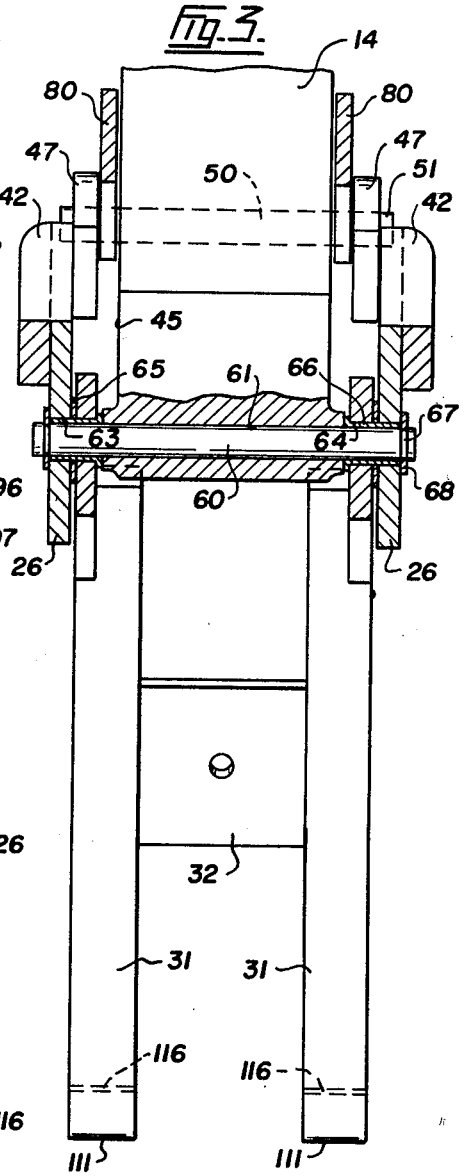
FIG. 3 is a vertical section taken on the line 3—3 of FIG. 1.

The grapple assembly generally indicated at 12 is shown in the drawings to comprise a frame 25 having parallel side members 26 connected by a cross member 27. Another somewhat smaller frame 30 of the grapple assembly has side members 31 and these parallel members are cross connected by a member 32. As shown best in FIG. 3, the frames 25 and 30 are secured to one another and to the outer end 15 of the boom by mounting means generally indicated at 34.

As will be described more fully later, the frame 25 is held against movement relative to the boom and so that the side members 26, in effect, form extensions of the boom. The frame 30 is supported by the mounting means 34 to swing about a horizontal and transverse axis with the side members 31 of the swingable frame also extending beyond the end of the boom. These extensions of the two frames 25 and 30 are curved inwardly towards each other as shown in FIG. 1 respectively to provide load-gripping portions 37 and 38 best suited for holding a load generally circular in cross section such as the log 40 indicated by dotted lines in FIG. 1.

More specifically, the side members of the fixed frame 25 extend from the mounting means 34 a short distance alongside the boom 14 and these reinforced portions of the side members provide cranks 42. Preferably there are two such cranks although one might be sufficient. These cranks are disposed parallel to side faces 45 of the boom and are secured thereto by suitable holding means generally indicated at 43. As shown in the drawings, the means 43 comprises a quadrant 47 is secured to each crank 42 and this quadrant is provided with notches 48 which are spaced apart on an arc centered upon the horizontal and transverse axis provided by the mounting means 34. The linkage means 20 includes a shaft 50 the ends of which project laterally one from each side face 45 to provide stop members 51. The members 51 serve as means for holding the fixed frame 25 against swinging movement about the mounting means 34, the members being lodged in selected notches 48 to achieve this result. It should be noted that the quadrants 47 and the stop members 51 allow the fixed frame 25 to be adjusted on the boom to a slight extent at least and so that the log-gripping portion 37 is tilted either upwardly or downwardly from the position shown in FIG. 1.

The side members of the swingable frame 30 are fitted with cranks 54 which are connected to parts of the linkage means 20 as will be described later. The side members 31 of the swingable frame which support the cranks 54 are parallel to one another and are spaced within the parallel side members 26 of the fixed frame.

Thus, the two frames can be swung by the ram 18 between fully open and fully closed positions with the load-gripping portions 37 and 38 crossing one another intermediate their lengths as shown by the dotted and solid lines to the right of FIG. 1.

The mounting means generally indicated at 34 comprises a shaft 60 which slidably extends through a transverse bore 61 formed in the end of the boom. Normally, this bore 61 receives a suitable shaft for securing the backhoe bucket to the outer end 15 of the boom. Opposite end of the shaft 60 project laterally beyond the side faces 45 of the boom and then through holes 63 and 64 respectively formed in the side members 26 and 31 of the two frames. Washer-like spacers 65 are fitted to the shaft 60 between the side members of the frames and these spacers encircle bushings 66 which rotatably support the frame 30 on the shaft. Each opposite end of the shaft 60 has an annular channel 67 to receive a suitable retainer such as a snap ring 68. Thus, the two major parts of the grapple assembly are interconnected as a unit and are also detachably connected to the boom 14 so that the frame 30 can swing about the longitudinal axis of the transverse shaft 60 which, of course, is the horizontal axis of pivot previously referred to.

The ram generally indicated at 18 is shown in FIG. 1 to comprise a hydraulic cylinder 70, a rear end of which is pivotally mounted on the top of the boom as at 71. A piston rod 73 extends from the hydraulic cylinder and has a forward end fitted with a bearing 74. This piston rod is pivotally connected to the boom 14 and the cranks 54 by the linkage means 20.

Figure 2:
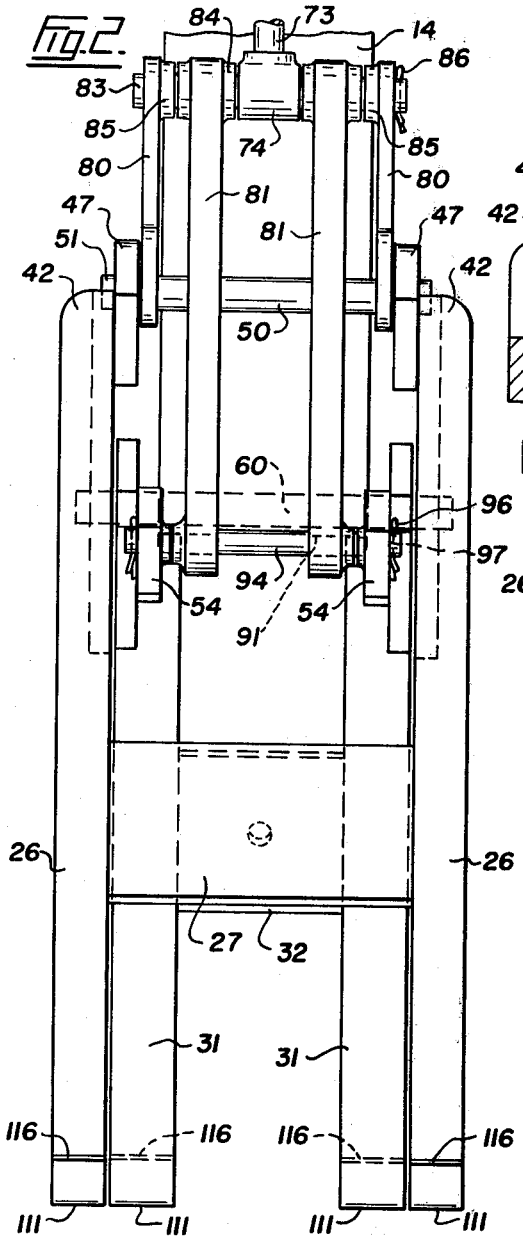
FIG. 2 is a front elevation of the apparatus.

The linkage means generally indicated at 20 comprises pairs of links 80 and 81 which are pivotally connected to the bearing 74 on the outer end of the piston rod by means of a pivot pin 83. Pin 83 slidably extends through the bearing 74 and, in a similar manner, extends through other bearings 84 and 85 provided on the ends of the four links, see FIG. 2. The pin 83 has laterally projecting ends which are apertured as at 85 to receive lockingdevices such as cotter pins 86. The opposite ends of the pair of links 80 are pivotally mounted on the opposite ends of the shaft 50 which form the stop members 51 for the fixed frame 25. In FIG. 1, the cranks on the swingable frame will be seen to be provided with suitably spaced openings 90. Other openings 91 (FIG. 2 only) formed in the overlapping ends of the pair of links 81 are aligned with the crank openings to receive a pivot pin 94. This pin 94, like the pivot pin 83, is secured against withdrawal by means of cotter pins 96 lodged in transverse apertures 97.

A grapple assembly constructed in the above described manner is easy to install on a backhoe boom once the digging bucket is removed. The frames 25 and 30 connected together by the bushings 66 are placed in a suitable position which will allow the lower end 15 of the boom to be entered between the crank portions 42 so that the stop members 51 can be lodged in their selected notches. When the bore 61 in the boom end is properly aligned with the holes 63 and 64 in the two frames, the shaft 60 is driven through the bore and the holes and is secured by means of the snap rings 68.

The links 81 and the cranks 54 on the swingable frame are then positioned relative to one another according to the desired opening and closing movement of the grapple assembly. The extent and speed of this opening and closing movement is determined by the openings 90 selected to receive the pivot pin 94. For example, the center opening 90 is shown in FIG. 1 are aligned with the openings 91 in the links. The pivot pin 94 is driven through these aligned openings and is secured against withdrawal by the cotter pins 96. This arrangement allows the load-gripping portion 38 to swing between the two dotted line positions shown in FIG. 1. The position on the left is the fully open position of the grapple assembly while the position on the right is the fully closed position.

In use, the driver of the backhoe operates the hydraulic controls available to him in order to manipulate both the boom 14 and the grapple assembly 12. The assembly is like a mechanical hand on the end of a similar arm, that is, it can be used to reach out and grasp an object in a natural sort of way, then pick up the object and place it in another position. A log, length of pipe, or many other irregular-shaped objects are easily handled by the apparatus preferably by being held reasonably near the point of balance. Furthermore, a grapple assembly when in the fully closed position is useful in maneuvering a load about on the ground. The rearwardly curved portion of the fixed frame can be used as a mechanical rake to roll a log, for example, in towards the backhoe or to a position where it can more readily be picked up. The cooresponding portion of the swingable frame which projects forwardly when the grapple assembly is closed can be used to roll the log in the opposite direction again without likelikhood of riding up the curved surface of the log.

Figure 4:
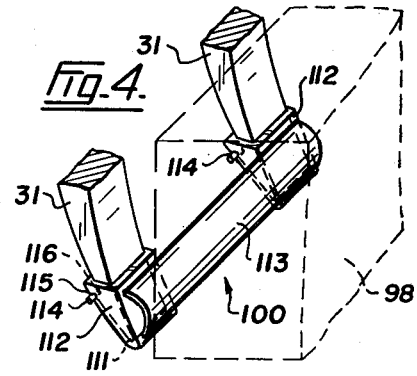
FIG. 4 is a perspective view showing one attachment for the grapple assembly.

The grapple assembly 12 will grip objects tightly enough to prevent the objects from slipping when clamped between the portions 37 and 38. However, some loads might be damaged by the clamping force which can be exerted by the curved portions 37 and 38 of the assembly. This might be the case if a heavy timber or bundle of packaged lumber formed the load, such a load being indicated at 98 in FIG. 4. The present apparatus therefore includes an attachement 100, see FIG. 4, which is adapted to be secured to the terminal ends of the side members of the two frames. These terminals are shaped to provide tapered points 111. The attachment 100 comprises a pair of correspondingly tapered sockets 112 which are joined together by a lifting bar 113. The bar 113, which preferably is substantially semi-circular in cross section, is located on sides of the pair of sockets opposite pins 114 which extend through aligned holes 115 in opposing walls of the sockets. The removable pins 114 rests on shoulders 116 formed on the side members above the points 111 so that the attachment 100 is easily installed and removed as required.

When the load 98 which may be square or rectangular in cross section is to be lifted, one attachment 100 is fitted to each of the frames of the grapple assembly. One attachment, of course, interconnects the side members 26 of the fixed frame. Another such attachment interconnects the side members 31 of the swingable frame. The bars 113 then oppose one another and engage the opposite and parallel sides of the load 98 near the bottom. The curved lifting bars bear against the sides of the load in such a manner that there is litle or no tendency to dig in or otherwise inflict damage to the lifted object.

Figure 5:
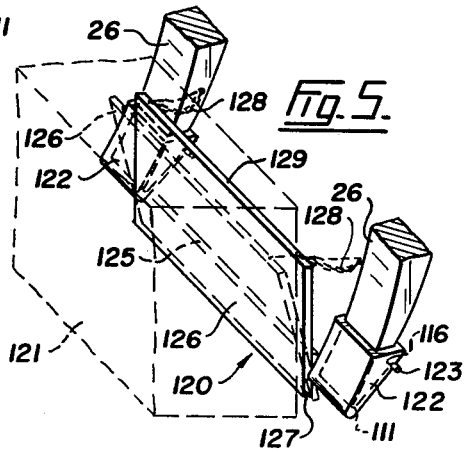
FIG. 5 is a perspective view showing another attachment for the assembly.

Referring now to FIG. 5, there is shown another attachment 120 for the grapple assembly. This particular attachment is used, for example, when an oblong box 121 or the like is to be lifted by the apparatus and particularly when the box is formed of an easily damaged material. Attachment 120 comprises a pair of tapered sockets 122 which are releasably secured one to each of the tapered points 111 by a removable pin 123 as before.

The sockets 122 are joined together by a connecting rod 125. Pivotally mounted on this rod is a rectangular pad 126. The rod 125 is spaced from and extends parallel to the lower edge 127 of the pad so that the pad is overbalanced on the rod. A short length of chain 128 connects upper edge 129 of the pad to the adjacent side member.

When an attachmnt 120 is fitted to each of the frames of the grapple assembly, the pads 126 are swung to a vertical position so as to bear flat against the sides of the box 121. The grapple assembly can then exert the required clamping force to lift the box and will do so without damaging the deformable sides of the load or the contents therein.

From the foregoing, it will be apparent the present invention provides a load carrying apparatus which makes a backhoe, or a similar machine which may have a telescopic boom, a much more versatile piece of equipment. The apparatus can handle a variety of loads and is particularly useful in picking up and transporting objects which are substantially circular in cross section. An attachment which can be secured to the grapple assembly ensures that a large and smooth surface load can be lifted without fear of damage or of being accidentally dropped. Another such attachment ensures that flat sided and possibly fragile objects such as boxes or crates can be lifted without damage thereto. The apparatus is particularly useful in sorting logs but can be employed as well in such tasks as land clearing where the load-gripping members of the grapple serve to tear out roots of stumps so that the stumps can later be extricated and piled for removal or burning. In addition, the grapple assembly being a mechanical hand provides sufficient dexterity to allow a building to be demolished using the apparatus. Objects can be extracted from hard-to-reach locations by the combination of a mechanical hand and an extensible and retractable boom so that the apparatus has many applications in addition to log sorting.

We claim:

1. Load carrying apparatus comprising an articulated boom having a outer end, a fluid operated ram pivotally secured at one end to the boom and having an opposite end adjacent the outer end, a grapple assembly including a fixed frame and a swingable frame, mounting means securing the grapple assembly to the outer end and permitting the swingable frame to swing about a transverse axis normal to a longitudinal axis of the boom, said mounting means including a transverse shaft removably supported in a bore formed in the outer end, said transverse shaft having opposite ends projecting laterally of side edges of the boom, said opposite ends providing journals for the swingable frame, said fixed and swingable frames each having side members providing crank portions near the outer end and opposed load-gripping portions projecting beyond said outer end, said load-gripping portions of the fixed and swingable frames being curved towards one another and transversely spaced apart whereby to cross when in fully closed position, holding means securing the crank portions of the fixed frame against movement relative to the boom, said holding means including a quadrant on each crank portion of the fixed frame, said quadrants each having spaced notches extending into an edge thereof, a stop member secured to the boom for entering into a selected notch of each quadrant, said crank portions of the swingable frame having spaced openings located at progressively increasing distances from the holding means, and linkage means pivotally connecting the crank portions of the swingable frame to the opposite end of the ram and to the boom whereby operation of said ram will move the grapple assembly between open and closed positions, said linkage means including a pair of links and a pivot pin carried thereby for entry through selected ones of said spaced openings in the crank portions of the swingable frame.

2. Load carrying apparatus as claimed in claim 1, and including a lifting attachment for each load-gripping portion, said side members of the fixed and swingable frames each terminating below the load-gripping portion in a tapered point adjacent a shoulder, said lifting attachments each comprising a pair of tapered sockets enclosing the tapered points of a load-gripping portion, a lifting bar connecting the pair of tapered sockets, said lifing bar being shaped to present a convex face to a load gripped by the load-gripping portion, and fasteners removably secured to the pair of tapered sockets in abutment with the shoulders releasably securing the lifting attachment to the side members.

3. Load carrying apparatus as claimed in claim 1, and including a lifting attachment for each load-gripping portion, said side members of the fixed and swingable frame each terminating below the load-gripping portion in the tapered point adjacent a shoulder, said lifting attachments each comprising a pair of tapered sockets enclosing the tapered points of a load-gripping portion, a lifting pad pivotally connected to the pair of tapered sockets for limited swinging movement towards and away from the side members, and fasteners removably secured to the pair of tapered sockets in abutment with the shoulders releasably securing the lifting attachment to the side members.

* * * * *